US007963546B2

(12) United States Patent
Veyrat-Charvillon

(10) Patent No.: US 7,963,546 B2
(45) Date of Patent: Jun. 21, 2011

(54) ARTICLE INCLUDING A STRAP FOR RETAINING OR TIGHTENING A FOOT OR A BOOT

(75) Inventor: Michel Veyrat-Charvillon, Les Ollières (FR)

(73) Assignee: Salomon S.A.S., Metz-Tessy (FR)

( * ) Notice: Subject to any disclaimer, the term of this patent is extended or adjusted under 35 U.S.C. 154(b) by 571 days.

(21) Appl. No.: 11/959,941

(22) Filed: Dec. 19, 2007

(65) Prior Publication Data

US 2008/0150259 A1 Jun. 26, 2008

(30) Foreign Application Priority Data

Dec. 20, 2006 (FR) ..... 06 11121

(51) Int. Cl.
*A63C 9/04* (2006.01)
*A63C 1/18* (2006.01)
*A43B 5/04* (2006.01)

(52) U.S. Cl. ..... 280/634; 280/11.33; 280/632; 36/50.5

(58) Field of Classification Search ..... 280/11.27, 280/11.3, 11.31, 11.33, 611, 623, 626, 628, 280/632, 634, 14.22, 14.23; 36/50.5, 7.7, 36/7.5, 7.6, 132; D02/909–912; D21/698, D21/760, 771, 773
See application file for complete search history.

(56) References Cited

U.S. PATENT DOCUMENTS

| | | | | |
|---|---|---|---|---|
| 1,319,269 | A * | 10/1919 | Collis | 280/11.3 |
| 4,190,969 | A * | 3/1980 | Baso | 36/50.5 |
| 5,277,635 | A * | 1/1994 | Gillis | 441/74 |
| 5,416,952 | A * | 5/1995 | Dodge | 24/68 R |
| 5,647,150 | A | 7/1997 | Romanato et al. | |
| 5,852,852 | A | 12/1998 | Rigal | |
| 6,394,484 | B1 * | 5/2002 | Maravetz et al. | 280/624 |
| 6,536,138 | B1 | 3/2003 | Miralles | |
| 6,669,211 | B2 | 12/2003 | Gonthier | |
| 6,944,971 | B2 | 9/2005 | Delgorgue et al. | |
| 7,232,147 | B2 | 6/2007 | Couderc | |
| 2002/0010987 | A1 | 1/2002 | Caeran et al. | |
| 2002/0101062 | A1 * | 8/2002 | Andrevon | 280/623 |
| 2003/0038456 | A1 * | 2/2003 | Carrasca | 280/624 |
| 2003/0093924 | A1 | 5/2003 | Delgorgue et al. | |
| 2003/0154631 | A1 * | 8/2003 | Hirayama | 36/117.1 |
| 2004/0061311 | A1 * | 4/2004 | De Bortoli et al. | 280/623 |
| 2004/0150193 | A1 | 8/2004 | Uchie et al. | |
| 2005/0046150 | A1 * | 3/2005 | Couderc | 280/623 |
| 2005/0280248 | A1 * | 12/2005 | Jean | 280/623 |
| 2006/0033310 | A1 * | 2/2006 | Naito et al. | 280/623 |
| 2008/0116664 | A1 * | 5/2008 | Warburton et al. | 280/633 |

FOREIGN PATENT DOCUMENTS

| | | |
|---|---|---|
| EP | 0 697 957 B1 | 2/1996 |
| EP | 1 175 841 A2 | 1/2002 |
| EP | 1 529 458 A1 | 5/2005 |
| FR | 2 853 557 A1 | 10/2004 |

* cited by examiner

*Primary Examiner* — Hau V Phan
*Assistant Examiner* — John R Olszewski
(74) *Attorney, Agent, or Firm* — Greenblum & Bernstein, P.L.C.

(57) ABSTRACT

An article that includes a strap for retaining or tightening a foot or a boot, the strap including a section for covering the foot or the boot, the covering section including a frame and a comfort element. The comfort element includes a synthetic material molded over the frame. In a particular embodiment, the article is a retaining device for a sports apparatus, such as a snowboard binding for a snowboard.

30 Claims, 3 Drawing Sheets

1
20
51
52
70
53
35
94
II
54
80
56
66
100
50
11
28
10
55
13
29
57
58
II
4
5
6
7
12
2
3

ARTICLE INCLUDING A STRAP FOR RETAINING OR TIGHTENING A FOOT OR A BOOT

CROSS-REFERENCE TO RELATED APPLICATION

This application claims priority under 35 U.S.C. §119 of French Patent Application No. 06 11121, filed on Dec. 20, 2006, the disclosure of which is hereby incorporated by reference thereto in its entirety.

BACKGROUND OF THE INVENTION

1. Field of the Invention

The invention relates to the field of sport articles including a strap for retaining or tightening a foot or a boot. The invention more particularly relates to a device for retaining a foot or a boot on a sports apparatus.

More particularly, the invention encompasses the field of snowboarding, as well as other gliding, rolling, and walking sports, including one or more straps for retaining or binding a foot or a boot onto a snowboard or a board of another such sport. The invention also relates to such retaining device or binding.

2. Description of Background and Other Information

Such articles are used for the practice of various sports, such as gliding, rolling, or walking sports, including snowboarding, skiing or water-skiing, snowshoeing, walking, or the like.

In the case of a device for retaining a boot on a snowboard, a strap conventionally includes a section that covers the boot. A reversible tightening mechanism allows for the selective tightening and loosening of the strap, that is, the covering section reversibly tightens the boot.

Conventionally, the covering section of such a strap includes a frame and a sheath. The frame provides the covering section with mechanical properties, especially with respect to the needed longitudinal tensile strength. Thus, even if the frame is transversely flexible, to assume the shape of the boot, i.e., particularly an upper surface of the boot, it remains substantially longitudinally inextensible. This allows for a substantially constant tightening of the strap. The sheath wraps around the frame to dampen the contact between the covering section of the strap and the boot. In other words, a surface of the sheath extends between the frame and the boot to provide comfort during tightening.

Conventionally, the sheath is formed by an assembly sewn with layers of textile material and synthetic material foam. Because of this, the sheath has the general appearance of a cushion wrapped around the frame. Thereby, the cushion provides tightening comfort.

Although the covering section provides a constant and comfortable tightening of the boot, it is somewhat bulky due to the number of layers of textile material and foam. This bulkiness hinders the manipulation of the strap by the user. Furthermore, the covering section can be relatively heavy, still due to the number of layers of textile material and foam. This additionally impedes the handling of the strap.

Furthermore, the stresses due to the tightening are typically centralized in the frame, which causes the dimensions of the frame to be adapted accordingly. This lends to increasing the weight of the covering section, and therefore, of the device.

Additionally, manufacturing the covering section tends to be a lengthy and relatively complicated operation. Indeed, several distinct pieces are initially required to be assembled in the manufacture of the cushion, which is then followed by the assembly of the covering section.

SUMMARY OF THE INVENTION

The invention reduces the bulk of the covering section of a retaining or tightening strap in order to facilitate the manipulation of the strap. In addition, the invention reduces the weight of the covering section of the strap. The invention also reduces the stresses exerted on the frame, as well as simplifies and reduces the time required in the manufacture of the covering section.

To these ends, the invention provides an article having a strap for retaining or tightening a foot or a boot, the strap including a section for covering the foot or the boot, the covering section including a frame and a comfort element. In a particular embodiment, the article of the invention is a retaining device for a sports apparatus, such as a snowboard binding for a snowboard.

The comfort element of the article of the invention includes a synthetic material molded onto the frame, i.e., the synthetic material of the comfort element is attached to the frame by having been overmolded thereto.

The comfort element is overmolded onto the frame so as to be an integral part thereof. Thus, the comfort element increases the portion of the covering section that is biased in traction during the tightening of the strap. This portion includes both the frame and the comfort element. This allows the stresses exerted on the frame to be reduced. In other words, the tensile stress is distributed within the covering section of the strap.

The comfort element replaces a cover, which saves on the use of layers of textile material and foam, thereby reducing the bulkiness of the covering section. Consequently, handling the tightening strap is easier. Having no cover also allows the weight of the strap to be reduced making it lighter.

In addition, the fabrication of the cover section is simplified and less time-consuming. Indeed, adding the comfort element by overmolding, by injection molding, for example, is simple and fast. Furthermore, the section made of two materials is esthetically more pleasing.

BRIEF DESCRIPTION OF DRAWINGS

Other characteristics and advantages of the invention will be better understood from the description that follows, with reference to the annexed drawings, by means of non-limiting embodiments showing how the invention can be made, and in which.

DETAILED DESCRIPTION OF THE INVENTION

Although the embodiments disclosed relate to a device for retaining a foot or a boot on a sports apparatus, such as a binding for a snowboard, they are also applicable to other articles, as mentioned above.

The first embodiment is shown in FIGS. 1 to 6.

Figure 1:
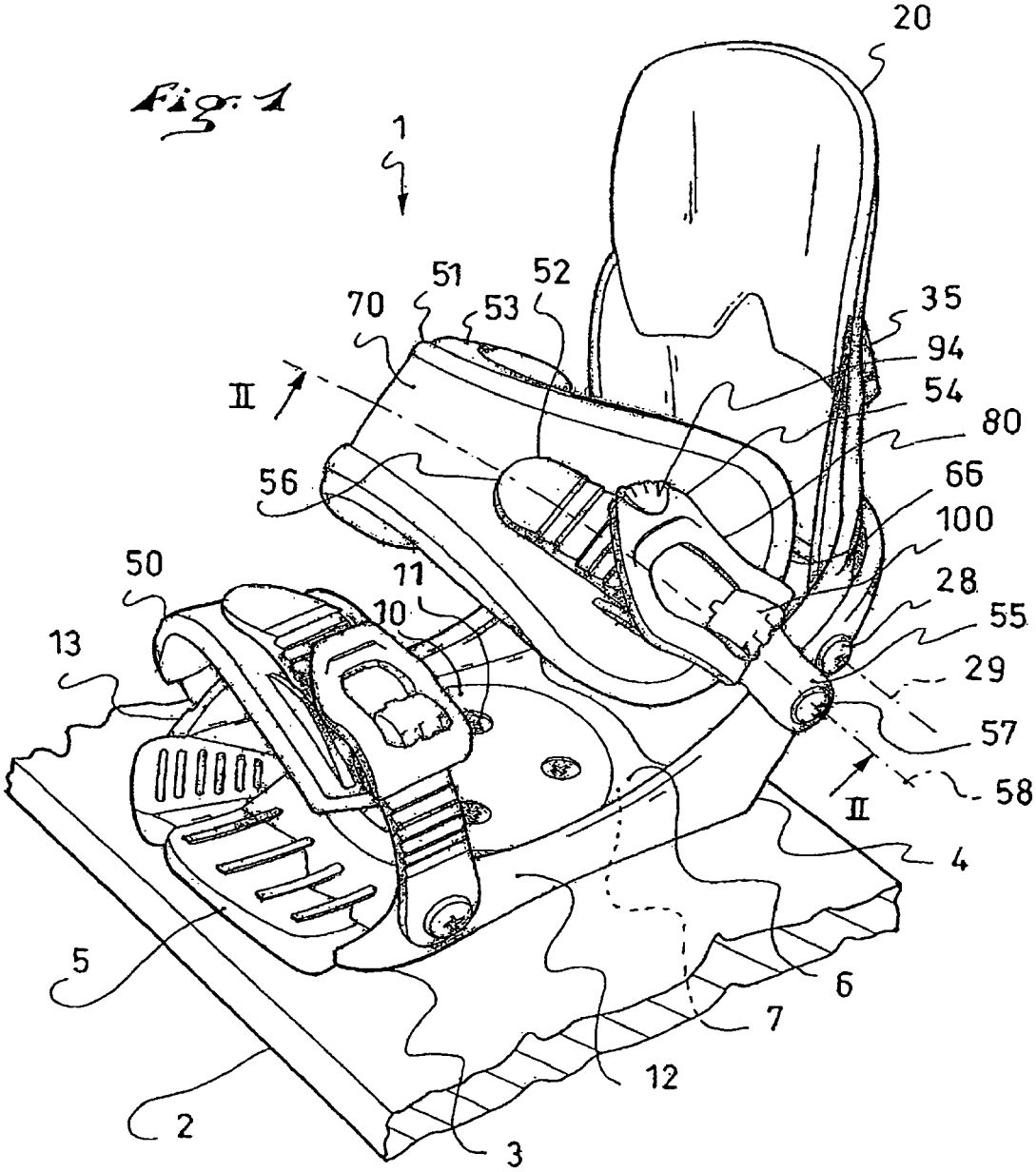
FIG. 1 is a perspective front view of a device for retaining a foot or a boot on a snowboard, with the straps of the device closed, according to a first embodiment of the invention.

As shown in FIG. 1, a sports article 1 or retaining device allows for temporarily retaining a boot (not shown) on an apparatus 2, such as, for example, a snowboard.

Although the device 1 relates more particularly to the field of snowboarding, the scope of the invention encompasses other fields, as mentioned above.

In a known manner, the retaining device 1 includes a baseplate 3, which extends in a longitudinal direction between a rear end 4 and a front end 5.

The baseplate 3 has an upper surface 6 provided to be opposite the boot sole, and a lower surface 7 provided to face the top of the board 2.

The baseplate 3 is retained to the board 2 by a means shown in the form of a disk 10, itself being attached to the board 2 with screws 11.

Alternatively, the baseplate 3 could be attached to the board 2 by other means.

The baseplate 3 is transversely bordered by a lateral flange 12 and by a medial flange 13. Each of the flanges 12, 13 is a part which forms, respectively, a lateral portion or a medial portion, respectively, of the device 1 to demarcate, transversely, a zone 14 for receiving the boot. When the boot is in place on the device 1, the flanges 12, 13 extend along the sides of the sole. Alternatively, something other than flanges 12, 13 could be provided to form the lateral and medial portions, such as, for example, mere lateral and medial stops or abutments.

The baseplate 3 and the flanges 12, 13 are made as a unitary piece made, for example, of synthetic material. However, the flanges could also be distinct parts provided to be connected to the baseplate by any means, such as by means of glue, screws, having been welded thereto, having been nested thereon, or by other means suitable for the purpose of providing such connection.

The device 1 also includes a rear support element 20, or highback, to allow the lower leg of the rider to be supported rearwardly.

According to a first embodiment of the invention, the rear support element 20 is associated with the flanges 12, 13, for example by means of a pivot or articulation 28. The articulation 28 is oriented to extend along a transverse axis 29 of the device 1, or substantially along axis 29. The articulation 28 can include any component such as a screw, a rivet, a washer, a screw nut, a swivel pin, or the like.

The articulation 28 enables the rear support element 20 to be moved toward the baseplate 3, which advantageously results in easier storage of the device 1.

The retaining device 1 also includes a stop 35 which limits the rearward movement of the support element 20.

Two straps 50, 51 are also provided to removably retain or tighten the boot with respect to the aforementioned support structure, i.e., with the boot supported on the baseplate 3 between the flanges 12, 13 in the receiving zone 14.

The first strap 50 is located toward the front of the device 1, in the area of the metatarsophalangeal joint of the foot, or the corresponding area of the boot, when the foot/boot is retained. A second strap 51 is located toward the rear, in the area of the instep when the foot/boot is retained.

Each of the straps 50, 51 transversely extends between the flanges 12, 13.

A different number of straps could be provided within the scope of the invention.

For convenience purposes, only one of the straps 50, 51, for example, the second strap 51, is further described. However, what applies to the second strap 51 is also applicable for the first strap 50 in this first embodiment.

Figure 2:
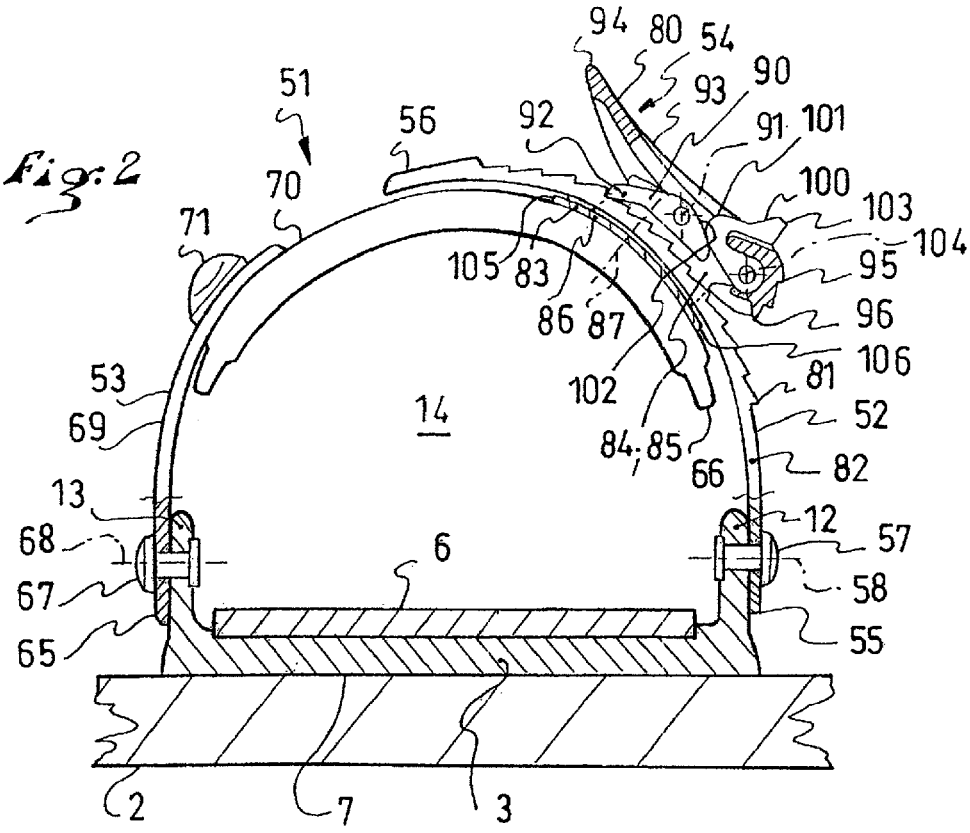
FIG. 2 is a cross-section along the line II-II of FIG. 1.

As can be understood from FIGS. 1 and 2, the strap 51 includes a first portion 52, a second portion 53, and a first mechanism 54 for connecting the two portions 52, 53.

The first portion 52 of the strap extends along its length (but transversely of the device 1, as seen in FIG. 1) between a fastening end 55 and a free end 56. The fastening end 55 is affixed to the lateral flange 12, for example by means of an articulation 57 extending along an axis 58. The articulation 57 can include or take the form of any of various elements, such as a screw, a nut, a rivet, or the like.

The second portion 53 of the strap extends along its length between a fastening end 65 and a free end 66. The fastening end 65 is affixed to the medial flange 13, for example, by means of an articulation 67 extending along an axis 68. Here also, the articulation 67 can include or take the form of any of various elements, such as a screw, a nut, a rivet, or the like.

According to the first embodiment, the second portion 53 of the strap is adjustable lengthwise, i.e., along its length. For this purpose, the second portion 53 includes, for example, a fastening section 69 on the side of the fastening end 65, and a covering section 70 on the side of the free end 66. An adjustment assembly adjustably connects together the two sections 69, 70. Such assembly includes, for example, a screw-nut connection 71, although other connecting structures are suitable. For example, the rounded element at the end of the lead line of reference numeral 71 can be regarded as representing a manipulable cap nut on the section 69 for receiving a screw that extends from the body of the covering section 70, or a manipulable head of a screw that extends to, and is received by, a nut on the body of the covering section 70 or which is embedded therewithin. In either case, the screw can extend through the hole 130, e.g., shown in FIG. 6.

The axes 58, 68 of the two articulations 57, 67, extend transverse to the longitudinal direction of the device 1, and perpendicular or substantially perpendicular to the longitudinal direction of the device 1, which enables the strap 51 to cover the boot uniformly.

The first connection assembly 54 is adapted to connect the second portion 53 of the strap to the first portion 52 removably, with the free end 56 of the first portion 52 overlapping, i.e., being above, the second portion 53. The first connection assembly 54 includes, for example, a ratchet tightening mechanism 80 affixed to the second portion 53, in the area of the free end 66 thereof. The first connection assembly 54 also includes a series of teeth 81 configured on the first portion 52 of the strap. The teeth 81 are distributed from the free end 56 to the vicinity of the articulation 57. The teeth 81 cooperate with the pawl 90 to block the strap 51 at a predetermined tightening length.

The first portion 52 is made in the form of a rack, for example, fabricated of plastic material. The teeth 81 and the body 82 of the first portion 52 can be made as one piece, although the two parts 81 and 82 can be distinct and assembled together.

The tightening mechanism 80 is shown from the side in FIG. 2. It includes a U-shaped baseplate 83 provided to guide the first portion 52 of the strap. The baseplate 83 of the tightening mechanism includes a first flange 84 and a second flange 85 connected by a bridge 86.

The baseplate 83 is affixed to the second portion 53 of the strap, by means of a rivet at axis 87. Other means for affixing the baseplate to the second portion of the strap could alternatively be used, such as screws, glue, weld, or other suitable expedient.

The tightening mechanism 80 includes a pawl 90 pivotable about an axis 91 between the flanges 84, 85 of the baseplate of the tightening mechanism. An elastic means, such as a spring, constantly biases the pawl 90 so that a retention portion 92 of the pawl 90 is pushed toward the bridge 86. The retention portion 92 is shown in FIG. 2 as being in the form of a tooth.

A drive lever 93 includes a manipulation end 94, on the one hand, and a driving end 95 provided with at least one tooth 96, on the other hand.

A release button 100 has a cam surface 101 provided to push on a cam surface 102 of the pawl 90, and a manipulation end 103 is adapted to be actuated manually, such as by the hand of the user.

The drive lever 93 and the release button 100 are articulated on the same axis 104, between the flanges 84, 85. An elastic means, such as a spring, constantly biases the lever 93 so that the manipulation end 94 is biased toward the bridge 86.

Thus, without any outside influence, the parts which make up the tightening mechanism 80 occupy the positions shown in FIG. 2.

When the first portion 52 of the strap is situated along the bridge 86 between the flanges 84, 85, that is, within the U-shaped baseplate 83, the pawl 90 opposes an increase in the effective length of the strap 51, which means that the end 56 of the first portion 52 of the strap cannot move in a direction that extends from an inner edge 105 to an outer edge 106 of the baseplate 83, which would loosen the strap 51 upon the boot.

Displacing the end 56 of the first portion 52 of the strap in the opposite direction, however, is possible. To do so, a user can actuate the drive lever 93 by means of the end 94, so that the teeth 96 drive the portion 52. In this case, the end 56 of the portion 52 moves in a direction that extends from the outer edge 106 to the inner edge 105; which means that the tightening length of the strap 51 becomes shorter. The boot is thereby more strongly tightened.

Conversely, the user can loosen the strap, or even free the boot by opening the strap. To do so, the user only has to actuate, with one finger for example, the manipulation end 103 of the release button 100. The drive lever 93 is then not biased, its handling end 94 being positioned the closest to the bridge 86.

The cam surface 101 of the button 100 pushes on the cam surface 102 of the pawl 90, so that the retention portion 92 of the pawl 90 moves away from the bridge 86 and the first portion 52. The strap 51 can then be effectively lengthened because the pawl 90 no longer retains the first portion 52 of the strap.

As soon as actuation of the button 100 is stopped, the pawl 90 reassumes a retaining position.

An advantage resulting from the structure of the tightening mechanism 80 is that the manual actuation of the release button 100 tends to elongate and open the strap 51.

As can be understood, particularly from FIGS. 3 to 6, the covering section 70 of the strap extends along a longitudinal axis L, from a first end 110 to a second end 111, transversely from a first side 112 to a second side 113, thickness-wise from a support surface 114 to a free surface 115. The support surface 114, or under surface, is adapted to be applied against the foot or boot. Additionally, the longitudinal direction L is transversely oriented with respect to the retaining device 1. The second end 111 of the section 70 of the strap blends into the free end 66 of the second portion 53 of the strap 51.

As shown in FIG. 2, the strap 51 takes the shape of a downwardly concave arch, extending from the lateral flange 12 to the medial flange 13, with the inner side of the arch facing the boot-receiving zone 14 and the outer side facing away. The first portion 52 of the strap 51 overlaps the second portion 53. More specifically, the first portion 52 of the strap 51 overlaps the covering section 70 of the second portion 53 of the strap, and the fastening section 69 of the second portion 53 of the strap overlaps the covering section 70. Thus, the strap 51 comprises parts, i.e., portion 52, section 69, and section 70, with the section 70 being the innermost of the three parts, the other two both overlapping section 70. Accordingly, the section 70 engages the top of the boot and, as explained below, includes an elastically deformable comfort element 140. Also shown in FIG. 2 is that the boot-receiving zone 14 is transversely limited by the lateral and medial flanges 12 and 13, downwardly limited by support surface above the baseplate 3, and upwardly limited by the covering section 70 of the second portion 53 of the strap 51.

The covering section 70 includes a frame 120 that is substantially longitudinally inextensible to provide a stable tightening of the foot or boot, and also is flexible along a transverse axis W to allow the strap to adapt to the foot or boot.

The frame 120 can be considered to be a skeleton or an assembly of pieces forming a skeleton.

Figure 6:
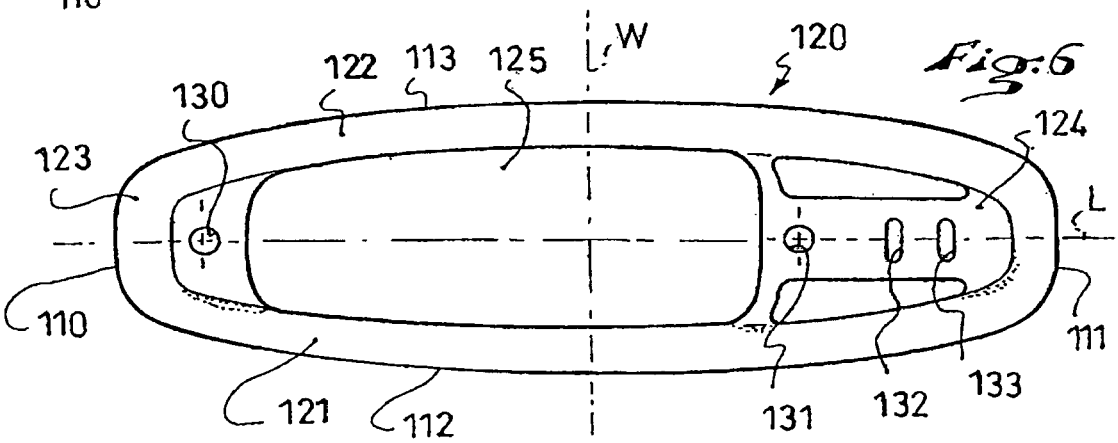
FIG. 6 is a top view of a covering section frame according to FIG. 3.

According to the first embodiment, as shown in FIG. 6, the frame 120 includes a first beam 121 extending along the first side 112 and a second beam 122 extending along the second side 113, as well as a first bridge 123 in the area of the first end 110 and a second bridge 124 in the area of the second end 111. In other words, the frame has an elongated or elliptical shape. The bridges 123, 124 connect the beams 121, 122 together. Further, the bridges 123, 124 maintain the beams 121, 122 spaced apart.

According to the first embodiment illustrated, the beams 121, 122 and the bridges 123, 124 form a unitary piece, which means that the frame 120 is a unitary piece. Alternatively, however, the frame could be an assembly of parts connected together.

The beams 121, 122 and the bridges 123, 124 form a continuous periphery extending around a central opening 125, such as a through opening.

The frame 120 can be made of plastic material, for example, constructed by any technique, such as injection molding, or the like. Such plastic material can be polyethylene, polyurethane, or any equivalent. The beams 121, 122 are dimensioned so as to be flexible along a transverse axis W and substantially inextensible along the longitudinal direction L. To this end, the cross-sectional area of a beam 121, 122 is far greater than the cross-sectional area of a thread used to make some textile materials or a strap. The cross section of each of the beams has an area equal to or greater than 1 $mm^2$ (i.e., one square millimeter). However, it is within the scope of the invention that the area of the cross section of each of the beams is greater than 5 $mm^2$.

Additionally, a hole 130 is provided in the first bridge 123 to facilitate with the connection 71 between the fastening section 69 and the covering section 70. Several holes are also provided in the second bridge 124, for example the three holes 131, 132, 133, to enable positioning the mechanism 80 on the covering section 70.

In addition, a comfort element 140 at least partially surrounds the frame 120.

Figure 3:
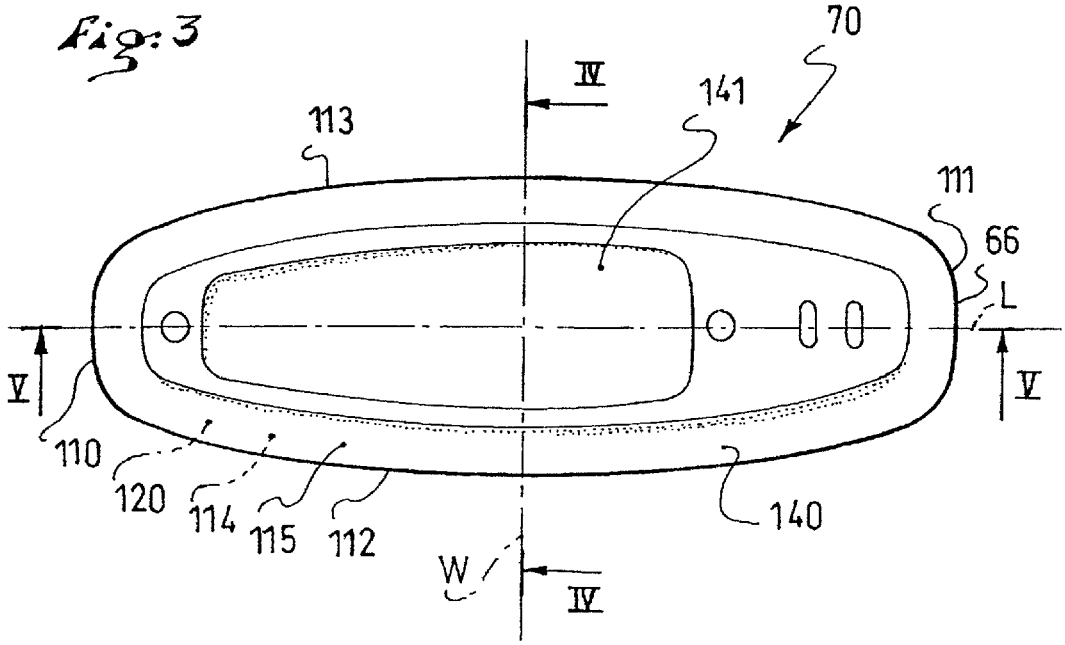
FIG. 3 is a top view of a covering section of a strap of the device of FIG. 1.
Figure 4:
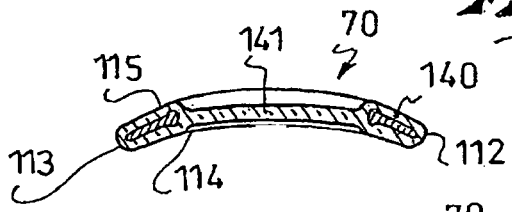
FIG. 4 is a cross-section along the line IV-IV of FIG. 3.
Figure 5:
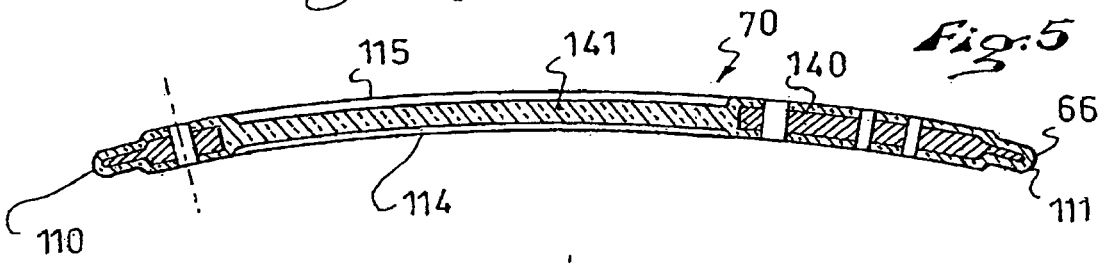
FIG. 5 is a cross-section along the line V-V of FIG. 3.

According to the invention, as can be understood from FIGS. 3 to 5, the comfort element 140 includes synthetic material molded onto the frame 120.

Molding the element 140 is a simple and fast technique, in comparison with a conventional sheath requiring various layers to be sewn together. Furthermore, molding enables a very close contact between the element 140 and the frame 120. Consequently, stresses imposed on the strap 51 due to steering forces (such as while a rider is using his/her snowboard while being retained by a device within the scope of the invention), for example, are distributed within the frame 120. In other words, the stresses are distributed more particularly in the beams 121, 122.

According to the first embodiment, the comfort element 140 covers substantially the frame 120 almost entirely, which means that the element 140 surrounds the first beam 121, the second beam 122, and also the first bridge 123 and the second bridge 124. In other words, the beams 121, 122 and the bridges 123, 124 are imbedded in the synthetic material comprised in the element 140.

Additionally, the material constituting the element also extends in the opening 125 in order to fill it entirely, still according to the first embodiment of the invention. In fact, the comfort element 140 forms a web 141 for closing the opening 125. The web 141 extends between the beams 121, 122 and between the bridges 123, 124.

In manufacturing the covering section 70, the frame 120 is made by any known technique, such as by plastic injection molding. Subsequent to such molding, the frame 120 is placed in a larger mold, thereby leaving room for the element 140, which is molded over the frame 120, i.e., attached to the frame by being overmolded thereto, by any known technique, again such as injection molding.

The frame 120 and the element 140 are each made of any synthetic material, such as polyurethane, polyamide, polyethylene, or any equivalent. However, the element 140 is reversibly elastically deformable, much like a spring, which means that it is extensible, losing its shape when biased, and then regaining its initial shape when no longer biased. By contrast, the frame 120 is substantially non-deformable elastically, during use, which means that it is inextensible. Consequently, the beams 121, 122 do not stretch/extend when the strap is being tightened.

The flexibility of the element 140, and therefore of the web 141, allows the covering section 70 to lay uniformly flat against the foot or boot. This is particularly true where the curvature varies, for example toward the instep or the front of the foot. The web 141 can deform to take on the shape of part of the boot that would tend to go between the beams 121, 122.

Therefore, the section 70 is highly geometrically adaptable to a foot or a boot.

The base molecule used to make the frame 120 or the element 140 can be the same, for example polyurethane. But this molecule is specifically dependent upon the required mechanical needs.

Figure 7:
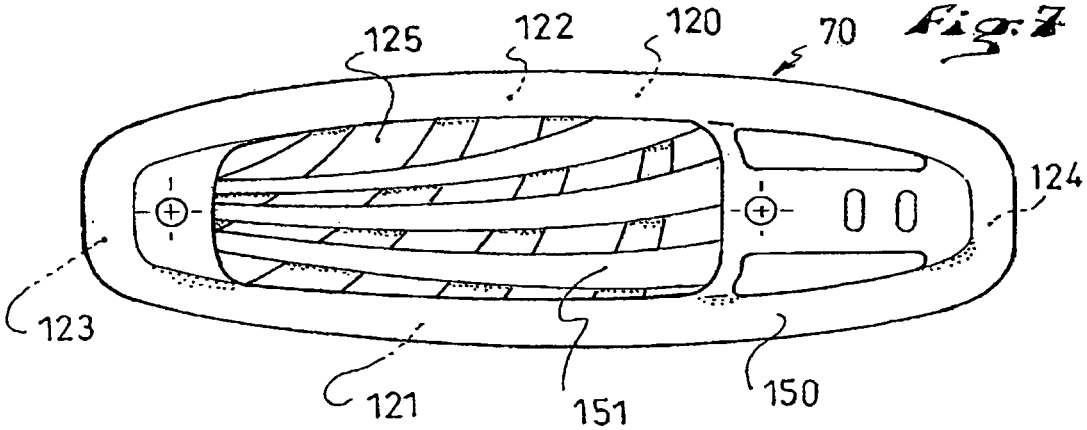
FIG. 7 is a top view of a covering section of a device strap according to a second embodiment of the invention.

The second embodiment is described hereinafter with reference to FIG. 7. For convenience purposes, the common elements with the first embodiment are designated with the same reference numerals.

Therefore, the second embodiment has a covering section 70, a frame 120 with a first beam 121, a second beam 122, a first bridge 123, a second bridge 124, and an opening 125.

A difference between the first and second embodiments lies in that the material from which the comfort element 150 is made does not entirely cover or fill up the opening 125. Here, the material forms a screen 151 in the opening 125, much like a meshed structure. The screen 151 extends between the beams 121, 122 and between the bridges 123, 124. The resulting technical effects and advantages are similar to those of the first embodiment.

Generally, the invention is made from materials and implementation techniques known to one having ordinary skill in the art.

The invention is not limited to the particular embodiments described herein, and includes all the technical equivalents within the scope of the claims that follow.

In particular, the invention also applies to the first strap 50, or front strap.

Any strap portion may or may not be adjustable in length.

The invention claimed is:

1. An article for retaining or tightening a foot or a boot, said article comprising:

a strap extending transverse to a longitudinal extent the foot or the boot when the foot or the boot is retained or tightened by the strap;

the strap comprising:

a first portion comprising a fastening end adapted to be affixed to a first side of a support structure for the foot or the boot with respect to which the foot or the boot is to be retained or tightened, the first portion of the strap extending along a length of the strap from the fastening end;

a second portion comprising a fastening end adapted to be affixed to a second side of a support structure for the foot or the boot with respect to which the foot or the boot is to be retained or tightened, the second portion of the strap extending along the length of the strap from the fastening end of the second portion;

the second portion further comprising a covering section for extending over and engaging the foot or the boot, the covering section comprising:

a frame;

an elastically deformable comfort element comprising a synthetic material overmolded to the frame;

the second portion of the strap further comprising a fastening section bearing said fastening end of the second portion of the strap;

the fastening section of the second portion of the strap having a free end overlapping the covering section of the second portion of the strap;

the first portion of the strap having a free end overlapping the covering section of the second portion of the strap when the foot or boot is retained or tightened by the strap so that the covering portion of the strap is positioned between the first portion of the strap and the foot or boot.

2. An article according to claim 1, wherein:

the frame comprises a first beam, a second beam, a first bridge, and a second bridge;

the first and second beams and the first and second bridges forming a contour around a through opening.

3. An article according to claim 2, wherein:

the synthetic material of the comfort element extends within the opening and entirely covers the opening.

4. An article according to claim 2, wherein:

the synthetic material of the comfort element forms a screen in the opening.

5. An article according to claim 2, wherein:

the cross-section of each of the first and second beams has an area equal to or greater than 1 $mm^2$.

6. An article according to claim 1, wherein:

the frame is a single unitary piece.

7. An article according to claim 1, wherein:

the comfort element covers substantially an entirety of the frame.

8. An article according to claim 1, wherein:

the frame and the comfort element are each made from synthetic material.

9. An article according to claim 1, wherein:

the synthetic material of the frame and the comfort element are each made of polyurethane.

10. An article according to claim 1, wherein:

the frame is substantially non-deformable elastically; and the comfort element is reversibly elastically deformable.

11. An article according to claim 1, further comprising:

a connection assembly having a manipulable member for removably connecting the first portion of the strap to the second portion of the strap.

12. An article according to claim 11, wherein:

the connection assembly comprises a ratchet tightening mechanism affixed to the second portion of the strap, said ratchet tightening mechanism comprising:

a U-shaped baseplate guiding movement of the first portion of the strap along the length of the strap;

the first portion of the strap having a plurality of teeth;

a pawl pivotally fixed to the U-shaped baseplate and a spring biasing the pawl in engagement with one of the plurality of teeth of the first portion of the strap; and the manipulable member is structured and arranged to selectively move the pawl into and out of engagement with the teeth of the first portion of the strap to enable relative movement between the first and second portions of the strap for selective tightening and loosening of the strap, as well as selective connection and disconnection of the first and second portions of the strap.

13. An article according to claim 1, wherein:

the strap has an arch shape with a concavity facing the foot or boot to be retained or tightened.

14. A device for retaining a foot or a boot on a sports apparatus, said device comprising:

a support structure adapted to support the foot or the boot on the sports apparatus;

an attachment assembly for attaching the support structure to the sports apparatus;

a strap extending transverse to a longitudinal extent the foot or the boot when the foot or the boot is retained or tightened by the strap;

the strap comprising:

a first portion comprising a fastening end fixed to a first side of the support structure for the foot or the boot with respect to which the foot or the boot is to be retained or tightened, the first portion of the strap extending along a length of the strap from the fastening end;

a second portion comprising a fastening end fixed to a second side of the support structure for the foot or the boot with respect to which the foot or the boot is to be retained or tightened, the second portion of the strap extending along the length of the strap from the fastening end of the second portion;

the second portion further comprising a covering section for extending over and engaging the foot or the boot, the covering section comprising:

a frame; and an elastically deformable comfort element comprising a synthetic material overmolded to the frame;

the second portion of the strap further comprising a fastening section bearing said fastening end of the second portion of the strap;

the fastening section of the second portion of the strap having a free end overlapping the covering section of the second portion of the strap;

the first portion of the strap having a free end overlapping the covering section of the second portion of the strap when the foot or boot is retained or tightened by the strap so that the covering portion of the strap is positioned between the first portion of the strap and the foot or boot.

15. A device according to claim 14, further comprising:

a tightening mechanism for selective tightening and loosening engagement of said covering section of said strap with the foot or boot.

16. A device according to claim 14, wherein:

the frame comprises a first beam, a second beam, a first bridge, and a second bridge;

the first and second beams and the first and second bridges forming a contour around a through opening.

17. A device according to claim 16, wherein:

the synthetic material of the comfort element extends within the opening and entirely covers the opening.

18. A device according to claim 16, wherein:

the synthetic material of the comfort element forms a screen in the opening.

19. A device according to claim 16, wherein:

the cross-section of each of the first and second beams has an area equal to or greater than 1 $mm^2$.

20. A device according to claim 14, wherein:

the frame is a single unitary piece.

21. A device according to claim 14, wherein:

the comfort element covers substantially an entirety of the frame.

22. A device according to claim 14, wherein:

the frame and the comfort element are each made from synthetic material.

23. A device according to claim 14, wherein:

the synthetic material of the frame and the comfort element are each made is polyurethane.

24. A device according to claim 14, wherein:

the frame is substantially non-deformable elastically; and the comfort element is reversibly elastically deformable.

25. A device according to claim 14, wherein:

the support structure comprises:

a baseplate adapted to be affixed to the sports apparatus;

a lateral flange and a medial flange, said lateral and medial flanges extending from said baseplate and transversely spaced apart to receive the foot or boot therebetween in a receiving zone;

the fastening end of the first portion of the strap being fastened to the lateral flange and the fastening end of the second portion of the strap being fastened to the medial flange.

26. A device according to claim 25, wherein:

the receiving zone for the foot or boot is transversely limited by the lateral and medial flanges, downwardly limited by a foot or boot support surface, and upwardly limited by the covering section of the second portion of the strap.

27. A device according to claim 14, wherein:

the attachment assembly for attaching the support structure to the sports apparatus comprises a disk for retaining the baseplate to the sports apparatus and screws for attaching the disk to the sports apparatus.

28. A device according to claim 14, further comprising:

a connection assembly having a manipulable member for removably connecting the first portion of the strap to the second portion of the strap.

29. A device according to claim 28, wherein:

the connection assembly comprises a ratchet tightening mechanism affixed to the second portion of the strap, said ratchet tightening mechanism comprising:

a U-shaped baseplate guiding movement of the first portion of the strap along the length of the strap;

the first portion of the strap having a plurality of teeth;

a pawl pivotally fixed to the U-shaped baseplate and a spring biasing the pawl in engagement with one of the plurality of teeth of the first portion of the strap; and the manipulable member is structured and arranged to selectively move the pawl into and out of engagement with the teeth of the first portion of the strap to enable relative movement between the first and second portions of the strap for selective tightening and loosening of the strap, as well as selective connection and disconnection of the first and second portions of the strap.

30. A device according to claim 14, wherein:

the strap has an arch shape with a concavity facing the foot or boot to be retained or tightened.

* * * * *